US006320552B1

(12) United States Patent
Volman et al.

(10) Patent No.: US 6,320,552 B1
(45) Date of Patent: Nov. 20, 2001

(54) ANTENNA WITH POLARIZATION CONVERTING AUGER DIRECTOR

(75) Inventors: Vladimir Volman, Newtown, PA (US); Garry Richard Hesselbacher, Mt. Holly, NJ (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 09/521,993

(22) Filed: Mar. 9, 2000

(51) Int. Cl.[7] ..... H01Q 13/00; H01Q 1/36
(52) U.S. Cl. ..... 343/772; 343/895
(58) Field of Search ..... 343/895, 772, 343/767, 850, 771

(56) References Cited

U.S. PATENT DOCUMENTS 2,945,227 * 7/1960 Broussaud ..... 343/772
3,778,839 * 12/1973 Kovar ..... 343/772
5,892,480 * 4/1999 Killen ..... 343/895
6,172,656 * 1/2001 Ohwada et al. ..... 343/895

* cited by examiner

*Primary Examiner*—Don Wong
*Assistant Examiner*—Hoang Nguyen
(74) *Attorney, Agent, or Firm*—W. H. Meise

(57) ABSTRACT

An antenna, or in the context of an array an antenna element, includes a feed and a separate polarization converting director. The polarization converting director includes a helically disposed conductor defining a pitch, a projected diameter, and a longitudinal axis. The feed propagates electromagnetic radiation (in transmit mode) toward the director, parallel its axis. The director intercepts part of the radiation, focuses or directs the radiation, and also converts circular polarization to linear, or linear polarization to circular. The feed may thus be linearly or circularly polarized. Various feeds include waveguides or horns, slots, dipoles, and planar or nonplanar spirals.

17 Claims, 10 Drawing Sheets

ANTENNA WITH POLARIZATION CONVERTING AUGER DIRECTOR

FIELD OF THE INVENTION

This invention relates to antennas, and more particularly to antennas using directors which adjust polarization.

BACKGROUND OF THE INVENTION

Antenna arrays are finding increasing use in various communication systems. A notable use of such arrays is for generating a plurality of beams for satellite-based cellular communications systems, but array antennas are widely used for radar and other sensors. In many cases, circularly-polarized elements are desired for use in an antenna array, for reasons which include polarization independence when receiving signals from linearly-polarized mobile user terminals which may be variously oriented, or for maintaining a particular level of transmitted power while maintaining relatively low electric field strength for each polarization.

Those skilled in the art know that antennas transduce bidirectionally between guided waves and unguided (free-space) waves. Antennas are reciprocal devices, which have the same parameters whether operated in a transmission mode or in a reception mode. More particularly, a transmitted "beam" has the same angular dimensions and gain as a "receive" beam, and the impedance at the guided-wave "feed" is the same in both transmission and reception modes. For historical reasons, the guided-wave terminals are referred to as "feed" terminals, regardless of whether the antenna is operated in a transmit mode or in a receive mode. Ordinarily, the guided-wave "feed" terminal(s) are coupled or connected to a "transmission-line," which as known is a guided transmission path having relatively low transmission loss andor relatively constant characteristic impedance between its terminals, but the feed terminals may be coupled directly to a source or utilization device, such as an electrode of a transistor, without an intermediary transmission line. Those skilled in the art also know that the terms "linear" and "circular" polarization refer to idealized conditions, seldom found in practice. Thus, a "linearly" polarized antenna or antenna element will, in actual use, often display or exhibit some residual response to the cross or orthogonal polarization relative to the nominal principal polarization. Similarly, a "circularly" polarized antenna or antenna element will often exhibit some response to the opposite hand of circular polarization relative to the nominal hand of polarization, and this cross-polarization component may be manifested as a finite "axial ratio." The axial ratio is the ratio, generally specified in decibels (dB), indicating the ratio of maximum to minimum amplitude response to all polarizations. A linearly polarized antenna or antenna element, if it were perfect, would exhibit an infinite axial ratio, while a perfect circularly polarized antenna would exhibit an axial ratio of zero dB. Real antennas, therefore, ordinarily exhibit an axial ratio which is neither zero dB nor infinite dB, and thus the terms used to categorize various types of antennas as circularly or linearly polarized must be understood to inherently include the word "nominally."

Crossed slot antennas are advantageous in that they are lightweight and do not project above the surface or plane of the array. A disadvantage of crossed slot antennas is that they cannot be fed in a simple manner except by a travelling wave in a waveguide context. Copending U.S. patent application Ser. No. 09/496,524, filed Feb. 2, 2000 in the name of Lier, describes an antenna array arrangement operating in disparate frequency bands, which includes an arrangement for feeding crossed slot antennas in one of the bands. The Lier arrangement requires multiple layers of microstrip or stripline transmission lines to effectuate the feed, which may not be advantageous, especially when power levels are significant. A salient disadvantage of slot antennas is that each slot tends to have a gain corresponding to that of an equivalent dipole, which is in the vicinity of 3 dB. Since the gain of an array antenna is dependent, in part, on the gain of the individual antenna elements of the array, an array fitted with slots as the radiating elements must, in order to provide a given gain, be larger in area andor in the number of antenna elements than a corresponding array using antenna elements having gain greater than 3 dB.

U.S. Pat. No. 5,258,771 issued Nov. 2, 1993 in the name of Praba describes an antenna array operating in two disparate frequency bands, which uses interleaved axial-mode "helical" antenna elements. Each such helical antenna includes a helically disposed electrically conductive element with a feed point adjacent a ground plane disposed orthogonal to the axis of the helix. Such helical antenna elements are well known, and have the advantage, when so fed against a ground plane, of providing moderately high gain, together with circular polarization. In order to reduce the interaction between the helical antenna elements of the arrays at the disparate frequencies as described by Praba, the helices of the two interleaved arrays are oppositely wound, so that a right-hand-circularly-polarized antenna element is adjacent a left-hand-circularly-polarized antenna element, which results in some degree of rejection of the cross-polarization signal from the adjacent elements, and thereby tends to reduce mutual coupling between the antenna elements of the two interleaved arrays.

A disadvantage of such axial-mode helical antennas is that they are three-dimensional, rather than two-dimensional as are the slot antenna elements. Thus, an array of axial-mode helical antenna elements occupies a volume defined by the area of the array and the axial length of the longest helical element. A further disadvantage of such helical antenna elements is the need for feeding each helical antenna element at a location adjacent the ground plane. Various schemes have been applied to couple signal between a transmission line and the proximal (ground-plane) end of the antenna element. One simple scheme couples signal to (or from) the helical antenna element by means of a coaxial transmission line, in which the center conductor is contiguous with (connected to or coupled to) the helical element and the outer conductor is connected to the ground plane. "Wye" coupling, which is coupling of the center conductor of a feed coaxial transmission line to a location on the helical element which is spaced away from the ground plane, has been used to improve the bandwidth of the antenna-element-plus-feed. When waveguide feed is desired, a probe must be coupled into the waveguide to intercept the electromagnetic field, and connected to the proximal end of the conductor of the axial-mode helical antenna element. A major problem with such probes is that of matching the impedance of the helical-element-plus-probe to the impedance of the waveguide. Impedance match is measured in various ways, one of which is the "return loss." A good (low) return loss over a range of frequencies ordinarily translates into an antenna with a broad operating frequency range.

Bifilar and multifilar helical antenna elements are also known, and have advantageous characteristics, such as operation in the absence of a ground plane. However, the feeding of bifilar antennas in most situations requires the use of one or more balanced-to-unbalanced (balun) converters, and such baluns may be difficult to make at some of the higher frequencies at which operation is desired. Further, even if a balun is available, some types of multifilar antennas may disadvantageously require that the feed of the helically disposed conductors of the antenna element be at the distal end of the helical structure, remote from a ground plane or support structure.

Improved array antenna elements are desired.

SUMMARY OF THE INVENTION

An antenna element according to an aspect of the invention comprises an electrically conductive "auger" element helically disposed, formed or wound about a longitudinal axis, and a feed spaced away from, and not connected to, the element, for transducing electromagnetic radiation propagating in the direction of the longitudinal axis.

In a nominally linearly polarized avatar of the antenna element, the feed is linearly polarized, and the helically disposed auger element converts between linear and nominally circular polarization. The feed may be an open (open-ended or radiating) waveguide a slot, a dipole, or any other source or sink of nominally linearly polarized electromagnetic energy. In a nominally circularly polarized avatar of the antenna element, the feed is nominally circularly polarized, and the helically disposed auger element may convert between linear and nominally circular polarization. In this avatar, the feed may include an open or open-ended waveguide structure, as for example a square, oval or circular waveguide, or it may include a crossed-slot or crossed-dipole antenna.

In one particular embodiment of an antenna element according to an aspect of the invention, the helically wound, formed, or disposed auger element has a projected diameter of about one-third wavelength at a frequency within the operating band. In that particular embodiment, the pitch of the helically wound element is about one-third wavelength. The pitch may be fixed over the axial length of the helically wound element, or the pitch may vary over that length. Similarly, the projected diameter may be fixed over the length of the helically wound element, or it may vary. In one embodiment exhibiting variation, the projected diameter is greater at a location lying between the ends of the helically wound element. Naturally, both the pitch and the projected diameter may vary over the length of the helically wound element.

A particularly advantageous embodiment of an antenna element according to a hypostasis of the invention supports the helically wound element on an electrically conductive rod extending axially through at least some of the turns of the helically wound element, or in one embodiment through all of the turns of the helically wound element. A feed according to one version of the invention may include a linearly polarized aperture surrounded by an electrically conductive material, in which the rod is supported by a further electrically conductive element oriented in the H plane of the feed, extending across the aperture, and in galvanic contact with the electrically conductive material surrounding the aperture, so that a continuous galvanic path extends from the conductive winding, through the rod, and through the further electrically conductive element to the electrically conductive material surrounding the aperture.

DESCRIPTION OF THE INVENTION

Figure 1A:
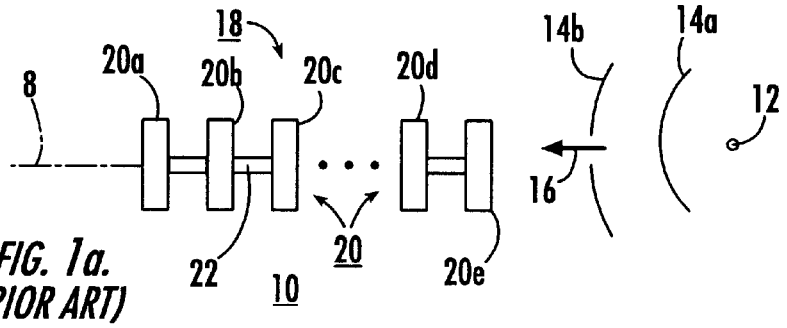
FIG. 1a. (PRIOR ART)
FIG. 1*a* is a simplified sid elevation illustration of a prior-art antenna or antenna element including a source of electromagnetic radiation, and using a surface wave impedance or "director" structure made from spaced-apart electrically conductive disks.

In FIG. 1*a*, a conceptual prior-art antenna element designated generally as 10 includes an omnidirectional source 12 of electromagnetic radiation, represented by circles 14*a*, 14*b* centered on the location of source 12. As is known to those skilled in the art, the omnidirectional source 12 is only a construct, as practical antennas do not exhibit true omnidirectional behavior. The omnidirectional electromagnetic radiation 14*a*, 14*b* from source 12 approximates a plane at significant distances from the source. As illustrated in FIG. 1*a*, the substantially planar wavefront 14*b* propagates in the direction 16. The prior-art arrangement includes a "travelling-wave director" 18 in the form of set 20 of a plurality of electrically conductive disks 20*a*, 20*b*, 20*c*, . . . 20*d*, 20*e*, seen edge-on in FIG. 1*a*, spaced apart from each other. As illustrated in FIG. 1*a*, the disks 20*a*, 20*b*, 20*c*, . . . 20*d*, and 20*e* are held in coaxial relationship by a rod 22. When rod 22 holds the axis 8 of director disks of set 20 substantially coaxial with direction of propagation 16, the disks tend to concentrate the electric field so as to increase the antenna "gain" in the direction of axis 8. Various explanations of this effect include the "slowing" of portions of the field in a manner which results in a focussing effect. This slowing effect results in the director's sometimes being termed a "travelling-wave structure."

Figure 1B:
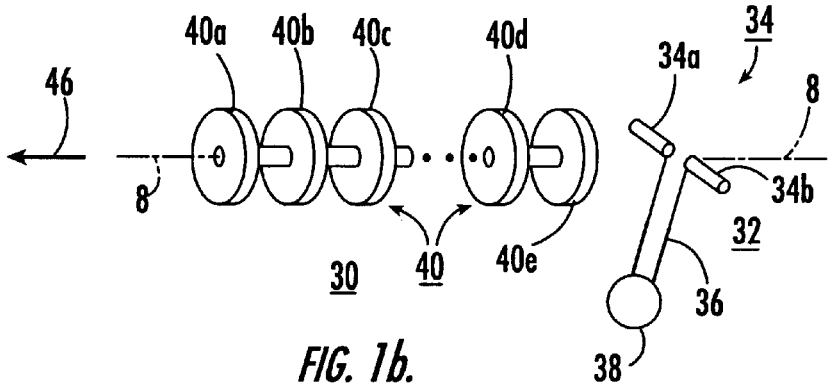
FIG. 1b. (PRIOR ART)
FIG. 1*b* is a perspective or isometric view of another antenna or antenna element in which the source of electromagnetic radiation is a linearly polarized dipole.

FIG. 1*b* illustrates a prior-art antenna 30 including a feed 32, which includes a dipole 34 with mutually aligned conductive elements 34*a* and 34*b*. Dipole 34 is fed, by a two-conductor transmission-line 36, at the points along dipole elements 34*a* and 34*b* which are closest to each other. A source or sink 38 of guided waves is connected to that end of transmission line 36 remote from dipole 34. Such an antenna will produce a directive beam of linearly polarized radiation in the direction of arrow 46 (keeping always in mind that operation in reception is equivalent to operation in transmission).

Figure 1C:
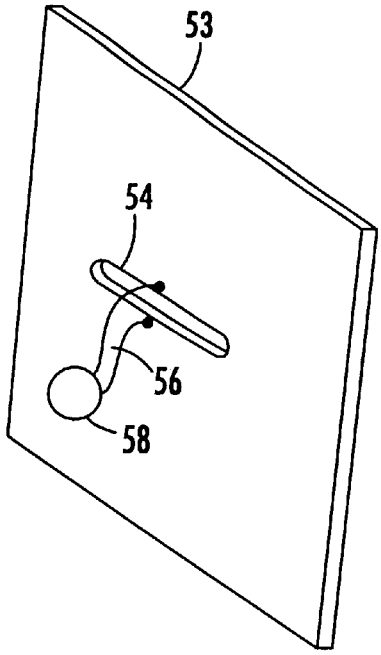
FIG. 1*c* is a simplified perspective or isometric view of a ground plane defining a slot which may be used as a feed in the arrangement of FIG. 1*a*.
Figure 1D:
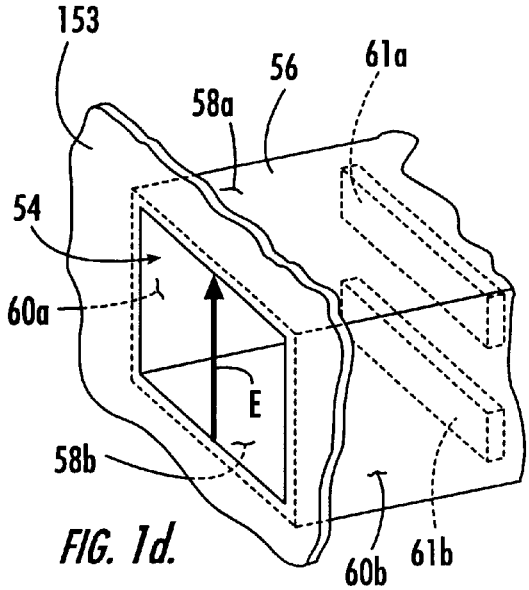
FIG. 1*d* is a simplified perspective or isometric view of a portion of a waveguide which may be used as a feed in the arrangement of FIG. 1*a;*

While the source of radiation or feed in the case of FIG. 1*b* has been illustrated as being a dipole, the source could as well be a linearly polarized slot antenna, as suggested in FIG. 1*c* by slot 54 defined in portion 53 of an electrically conductive plane, theoretically of infinite extent. In FIG. 1*c*, slot 54 is fed in conventional manner by a transmission line 56 coupled to a source or sink 58 of guided waves. Similarly, a linearly polarized open waveguide, illustrated as 56 in FIG. 2*d*, could be used as a feed for a longitudinal-disk-array director such as that of FIGS. 1*a* or 1*b*. Waveguide 56 has broad conductive walls 58*a*, 58*b*, spaced apart by narrow conductive walls 60*a*, 60*b*. In FIG. 1*d*, the open end 54 of the waveguide is a relatively good broad-band radiator for electromagnetic energy having it electric field E oriented parallel to the short sides 60*a*, 60*b* of the waveguide 56.

The orientation of the polarization of the feed element, corresponding to the axial orientation of the dipole element itself in the arrangement of FIG. 1*b*, or the axial orientation of the slot 54 of FIG. 1*c*, or of the waveguide opening 54 of FIG. 1*d*, when used with the longitudinal-disk-array director 38 of FIG. 1*b*, does not affect the operation of the disk-type director, as the director is is symmetrical for all polarizations normal to its longitudinal axis 8. In FIG. 1*d*, a ground plane 153 surrounds the waveguide aperture 54, and an impedance-matching device in the form of an iris formed from a pair of conductive bars 61*a*, 61*b* is located within waveguide 56.

Since the prior-art longitudinal-disk-array director 18 of FIG. 1*a* or 38 of FIG. 1*b* is insensitive to polarization, it can be used with equal effectiveness with either a linearly-polarized source, such as those illustrated in FIG. 1*b*, 1*c*, or 1*d*, or with a circularly-polarized source such as, for example, a crossed-dipole array with quadrature feed (not illustrated).

Figure 2:
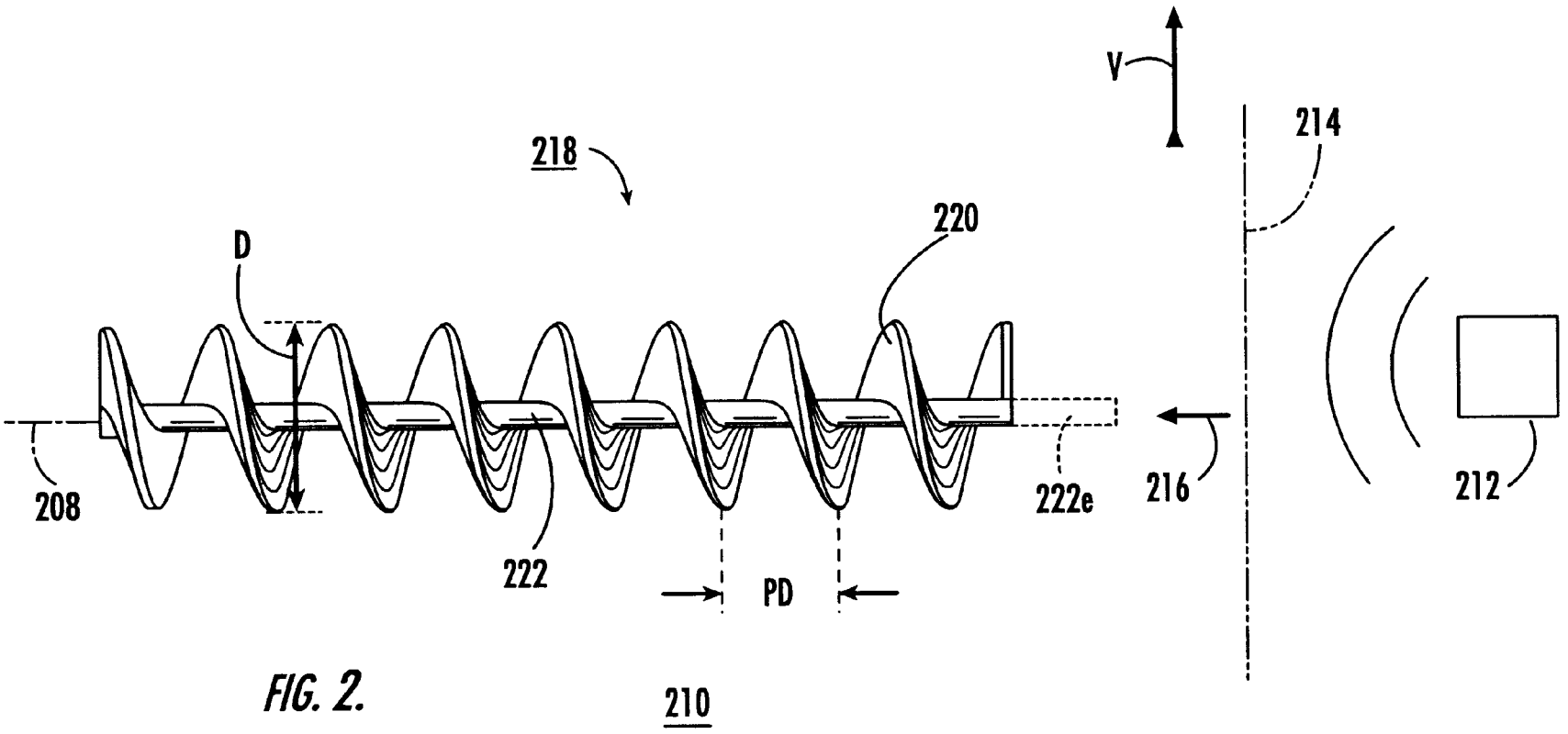
FIG. 2 is a simplified illustration of an antenna or antenna element according to an aspect of the invention, which includes a feed source for transducing electromagnetic energy generally along an axis of propagation, and a helically disposed electrically conductive "auger" directive element having its axis aligned with the axis of propagation.

FIG. 2 is a side elevation view of an antenna element 210 according to an aspect of the invention. In FIG. 2, a source 212 produces a linearly polarized electromagnetic field 214 which propagates in direction 216. The direction of polarization may be taken to be the "vertical" direction suggested by arrow V. A polarization rotating "auger" director 218 according to an aspect of the invention includes an electrically conductive element 220 having a generally helical shape about an axis 208 of elongation. The general appearance of the director 220 of FIG. 2 is that of a screw thread or auger, and hence the appellation. The axis 208 of elongation of the helically disposed element is parallel to the direction 216 of propagation of the electromagnetic field 214. Like the disk-type director of the prior art, the director 220 of FIG. 2 increases the gain along the axis of the director. It has been discovered that, unlike the disk-type director arrangement of the prior art, the arrangement of FIG. 2 is capable of rotating the polarization of the incident electromagnetic wave 214. More particularly, if the linearly polarized electromagnetic field 214 is incident on the right side of helical director 220 as illustrated in FIG. 2, the resulting far-field radiation pattern will include a beam attributable to the director, and that beam will be nominally circularly polarized, and the hand of polarization will depend on the hand of rotation of the "screw" thread of the auger director element.

The helically wound conductor of a director of an antenna element according to the invention may be self-supporting, or, as illustrated in FIG. 2, may be supported on a rod 222. The support rod 222 may be made of a dielectric material, but a preferred embodiment of the invention has an electrically conductive support rod. While the structure 222 is termed a "rod," it should be understood that it may be fabricated as a monolithic part of the overall structure, much as a threaded screw is made from one piece of metal, rather than having a thread element supported by a separate rod. The projected area of the helical director 220 of FIG. 1 is determined by the projected diameter D, and the pitch is defined by the pitch distance PD lying between corresponding locations along the length.

Figure 3A:
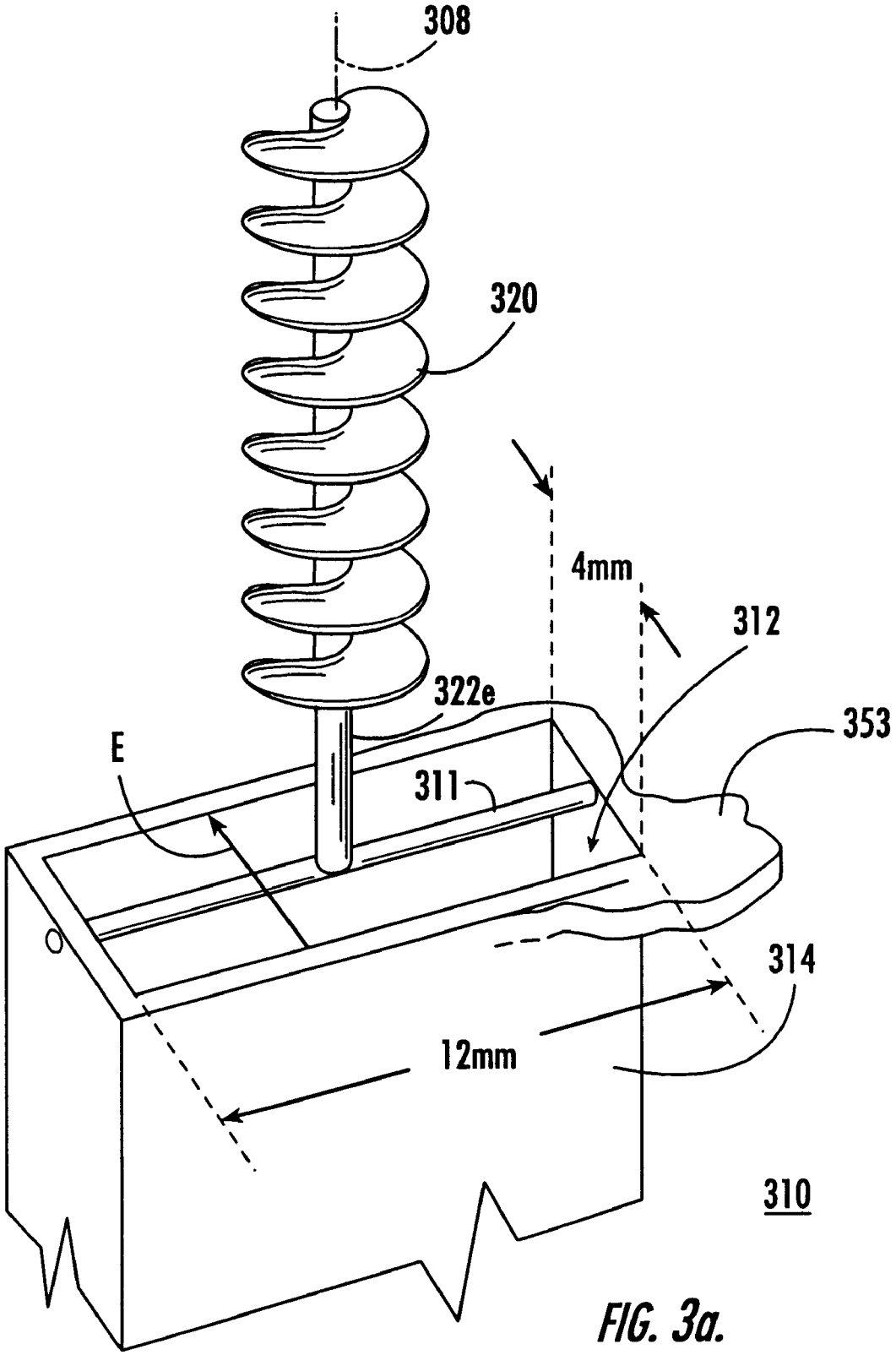
FIG. 3*a* is a simplified perspective or isometric view of an antenna according to an aspect of the invention, in which the feed includes a waveguide.
Figure 3B:
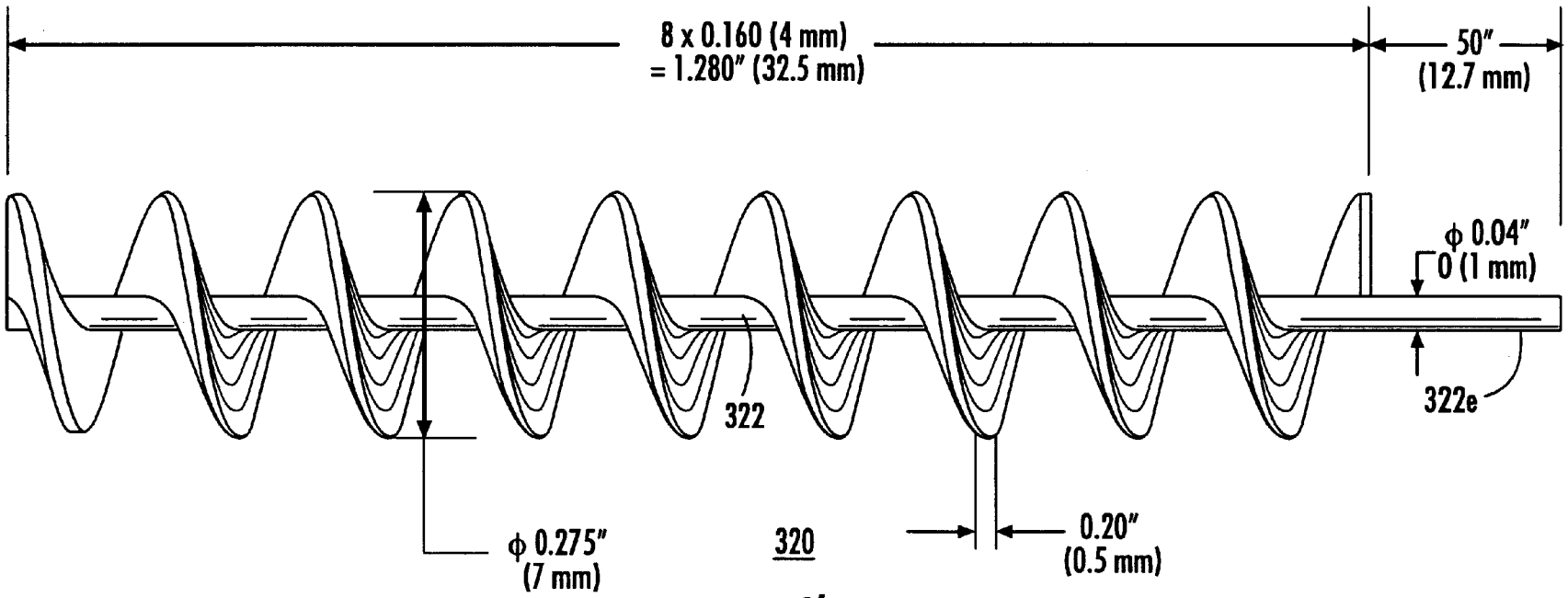
FIG. 3*b* is a side elevation view of the auger director portion of the arrangement of FIG. 3*a*, with certain dimensions set forth.

FIG. 3*a* is a simplified perspective or isometric view of an antenna according to an aspect of the invention, and FIG. 3*b* is a side elevation view of the auger director portion of the arrangement of FIG. 3*a*. In FIG. 3, helical director 320 is illustrated only by its cylindrical outline. An electrically conductive extension 322*e* of electrically conductive support rod 322 extends from director 220 to the center of an electrically conductive transverse support rod 310, which extends in the "H" plane (orthogonal to the E plane, in which the electric field lies) across the open mouth 312 of a rectangular waveguide 314. The H orientation of the transverse support rod 301 prevents the "shorting" of the electric field lines E extending across the mouth 312. This further has the advantage, since the entire helical director 220 is electrically connected (also known as a Galvanic connection) to support rod 220 and its extension 220*e*, and support rod 220*e* is directly connected by way of transverse support rod 310 to the conductive walls of waveguide 314, of having all salient portions of the antenna structure at the same electrical potential. Put another way, every part of the antenna 310 of FIG. 3 is at "ground" or a common voltage. This is highly advantageous for antennas for use in conjunction with spacecraft, where unwanted electrical charge can accumulate on dielectric (nonconductive) surfaces, and may achieve sufficient potential to cause arc discharges or possibly even to destroy antenna or associated structures. The continuous electrically conductive helically wound director, with its conductive support rod 322*e* and Galvanic connection to the walls of a feed waveguide, prevents such unwanted accumulation of electrical charge, and in principle should prevent any discharge attributable to voltage differences on the antenna structure. In FIG. 3*a*, the location of a ground plane, if any, is illustrated by portion 353 affixed to the walls of waveguide 314 adjacent open waveguide aperture 312 of waveguide 314.

Figure 4A:
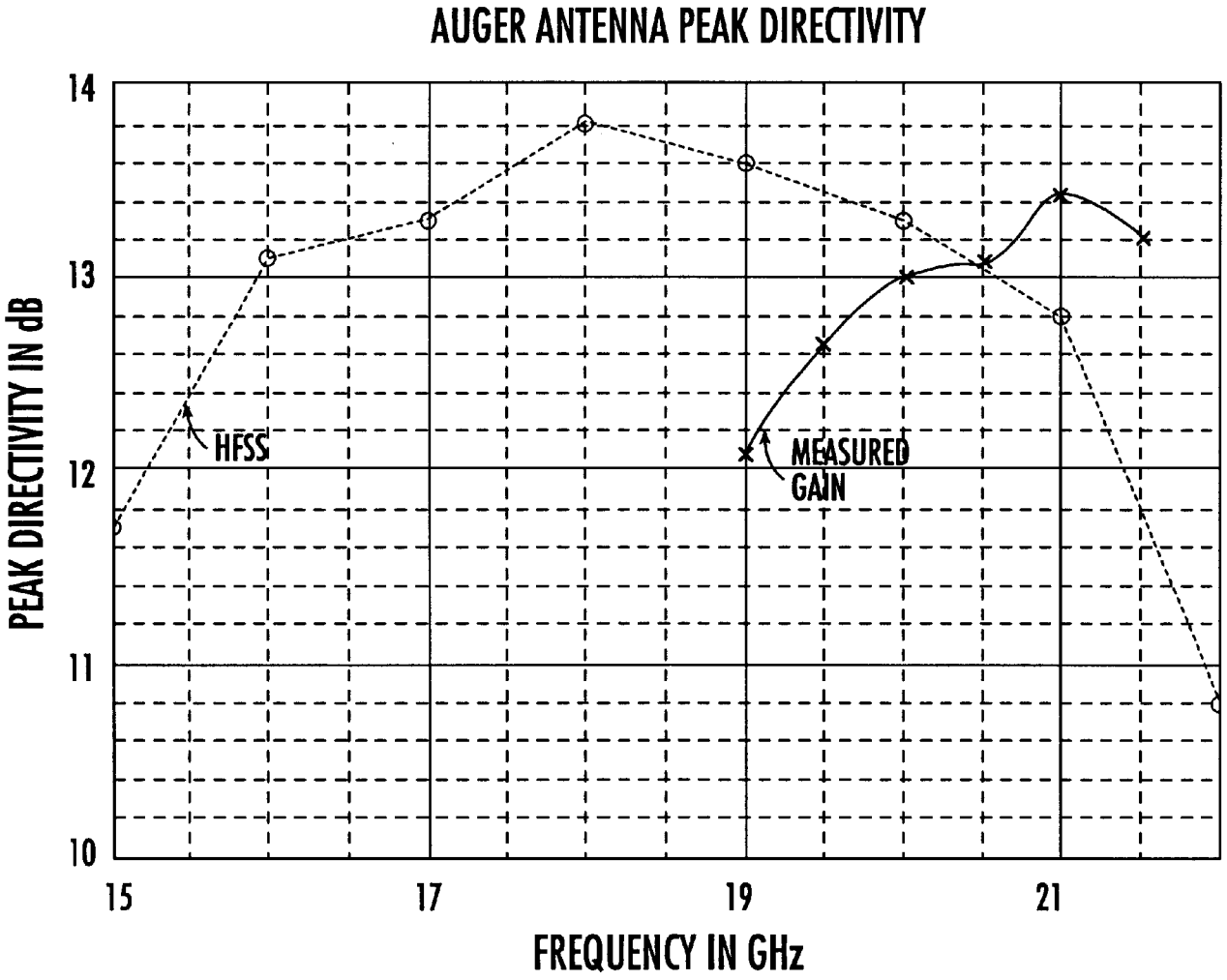
FIG. 4*a* illustrates as plots the calculated and measured gain, as a function of frequency, of an antenna as illustrated in FIGS. 3*a* and 3*b*.

FIG. 4*a* is a plot of an "auger" director having the dimensions set forth in FIG. 3*b*, used in conjunction with an open-waveguide feed waveguide having inside dimensions of 4×12 mm, as illustrated in FIG. 3*a*, in the frequency range from 15 to 21.5 GHz. In this frequency range, the free-space wavelength (λ) varies from about 20 to about 14.2 mm. The helically disposed director 320 used to make the plots of FIG. 4*a* had eight turns, each having an axial length or pitch of 0.160 inch (4 mm), for a total of 1.280 inches (32.5 mm) of axial length of the helical portion, and the support rod extension 322*e* added another half-inch (12.7 mm) to the overall axial length. The 4 mm pitch is about one-third the wavelength near the center of the bandwidth. The support rod diameter was 0.040 inch (1 mm). The projected diameter of the auger director was 0.275 inch (7 mm), also about one-third wavelength. The plot designated HFSS in FIG. 4*a* is the result of a simulation, and the plot labeled "measured gain" represents the gain measured on the actual embodiment of the director. As illustrated, the peak gains of both simulated and actual plots is about 13.5 dB. By contrast, the gain of the open waveguide feed, by itself, was about 7.5 dB. While this may at first blush appear to be an improvement of only six dB, it must be remembered that the gains in the plots of FIG. 4*a* are for what amounts to a circularly polarized signal, so are about 3 dB less than what would be measured with a linearly polarized signal. Thus, the gain improvement of the director-fitted open waveguide may be viewed as being about nine dB, taking the polarization into account. The measured axial ratio of the antenna on which the gain plots of FIG. 4*a* were made was about 2 dB in the range from 19.5 to 21.5 dB. Calculated return loss (looking into a port, not illustrated, of the waveguide 314) was no greater than 10 dB over the frequency range of 15 to 22 GHz. While the gain indicated by the simulation seems to match the measured gain, the frequency scale appears to be off, thereby indicating that the simulation did not properly take all of the variables into account.

Figure 4B:
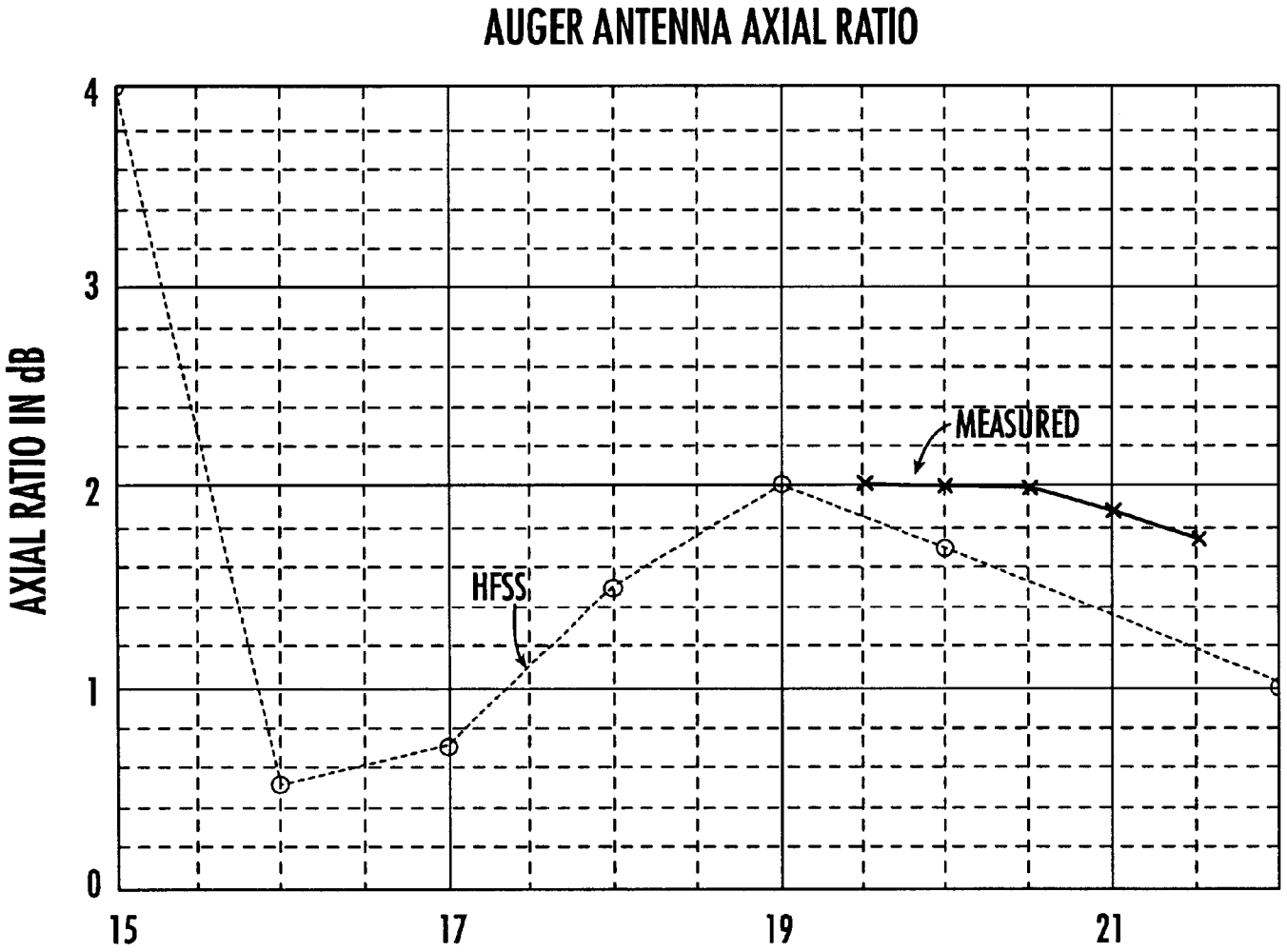
FIG. 4*b* illustrates the calculated and measured axial ratios.

FIG. 4*b* is a plot of measured and calculated axial ratio of the antenna of FIGS. 3*a* and 3*b* over the same frequency range as that of FIG. 4*a*. As illustrated, the axial ratio ranges from one-half to two dB.

Since an antenna is reciprocal, the operation in the reception mode should transduce circular polarization to linear polarization, so that the linear polarization can be received by the linearly polarized feed (with the feed, of course, operating in the "sink" mode). When the antenna according to the invention is fed from a circularly polarized source, it should provide directivity enhancement much as a longitudinal-disc-array director, and pass the circular polarization without polarization conversion.

Figure 5:
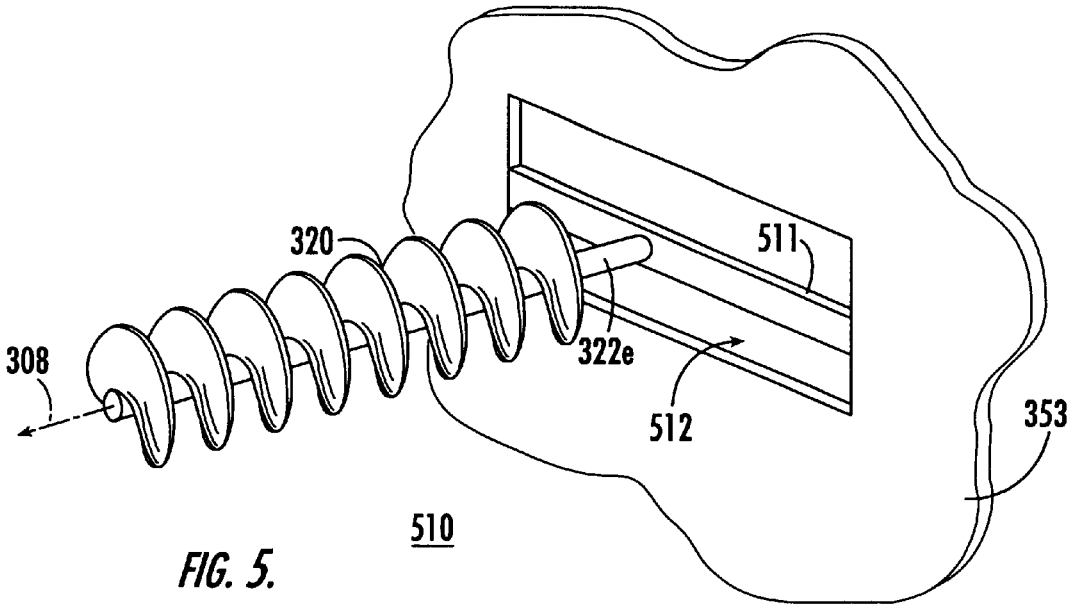
FIG. 5 is a simplified perspective or isometric view of an antenna according to an aspect of the invention in which the feed includes a slot defined in a portion of a ground plane.

FIG. 5 is a simplified perspective or isometric view of an antenna 510 in which the feed includes a slot 512 defined in a portion of a ground plane 353. Slot 512 has a support structure 511 extending thereacross in the H-plane, and has an auger director 320 mounted on the support 511. Such a slot-in-ground-plane feed is adaptable for use in a multielement array of antennas such as 510.

Figure 6:
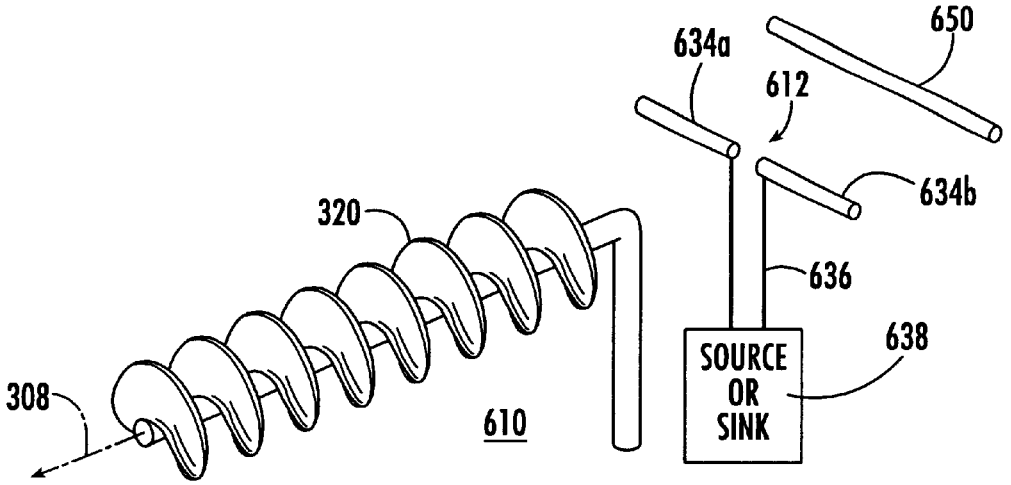
FIG. 6 is a simplified perspective or isometric view of an antenna according to an aspect of the invention, in which the feed includes a dipole.

In FIG. 6, the auger director 320 of antenna 610 is fed from a dipole antenna 612, which includes coaxial first and second portions 634*a* and 634*b*, fed in conventional manner from a source or sink 638 by way of a transmission line illustrated as a two-wire line 636. A reflector element may be used with such a dipole feed antenna. In FIG. 6, the reflector is illustrated as being a single conductive rod 650 having a length somewhat greater than the overall length of dipole 612. However, other types of reflector may be used, including solid-surface corners and parabolas, mesh structures, conductive-plated dielectric supports, and other conventional structures.

Figure 7:
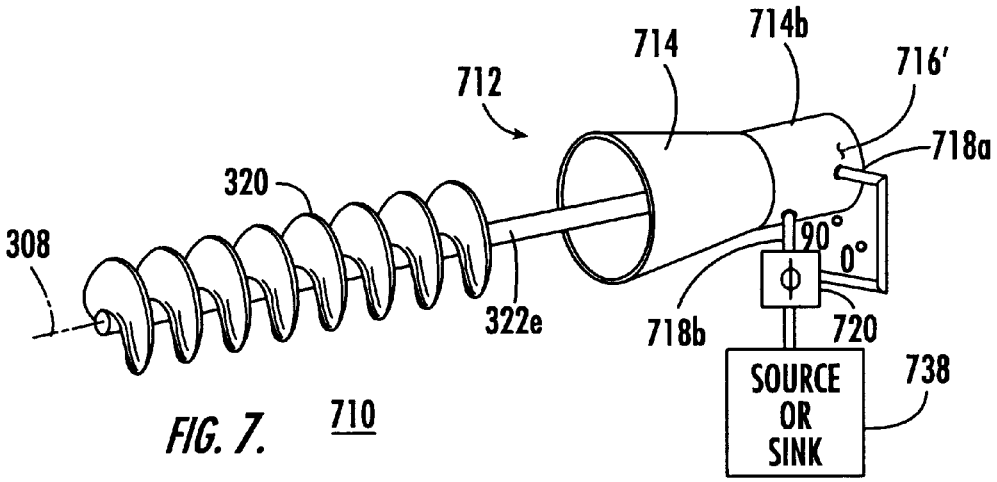
FIG. 7 is a simplified perspective or isometric view of an antenna element according to an aspect of the invention, in which the feed is a circularly polarized horn or waveguide.

FIG. 7 is a simplified perspective or isometric view of an antenna element 710 according to an aspect of the invention, in which the feed 712 is circularly polarized. In FIG. 7, the circularly polarized feed includes a tapered circular horn section 714*a* coupled to a cylindrical circular waveguide 714*b* terminated in a short-circuiting plate 716. The cylindrical waveguide portion 714*b* is fed in conventional manner by a pair of mutually orthogonal probes 718*a*, 718*b* projecting into the waveguide, and excited by a phase shifting arrangement 720 which receives signal from, or couples signals to, a source or sink 738. The phase shifting arrangement 720 feeds the probes 718*a*, 718*b* with a relative quadrature (90°) phase shift at a frequency within the frequency band of operation. The support rod 322*e* projects axially through the horn section 714*a* and cylindrical waveguide section 714*b*, and is fastened to the center of the short-circuiting plate 716.

Figure 8:
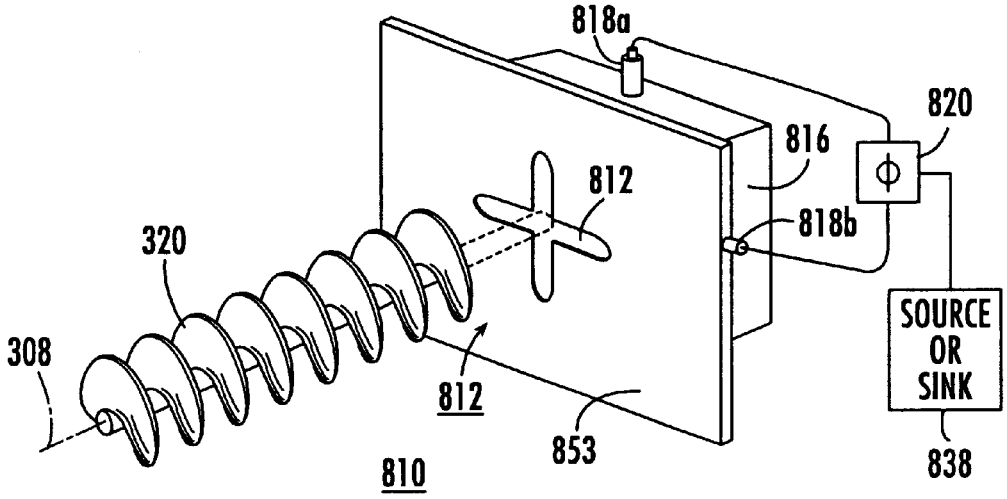
FIG. 8 is a simplified perspective or isometric view of an antenna or antenna element according to an aspect of the invention, in which the feed includes a circularly polarized crossed slot in a portion of a ground plane.

FIG. 8 is a simplified perspective or isometric view of an antenna element 810 according to an aspect of the invention, in which the feed 812 is circularly polarized. In FIG. 8, the circularly polarized feed includes a crossed slot 812 in a portion 853 of a ground plane. The crossed slot 812 is backed by a conductive cavity designated 816. The cavity 816 is fed in conventional manner by a pair of mutually orthogonal probes 818*a*, 818*b* projecting into the cavity, and excited by a phase shifting arrangement 820 which receives signal from, or couples signals to, a source or sink 838. The phase shifting arrangement 820 feeds the probes 818*a*, 818*b* with a relative quadrature (90°) phase shift at a frequency within the frequency band of operation. The support rod (illustrated in phantom) projects axially through the center of the crossed slot 812, and is fastened to the inside of the rear of the cavity 816.

Figure 9:
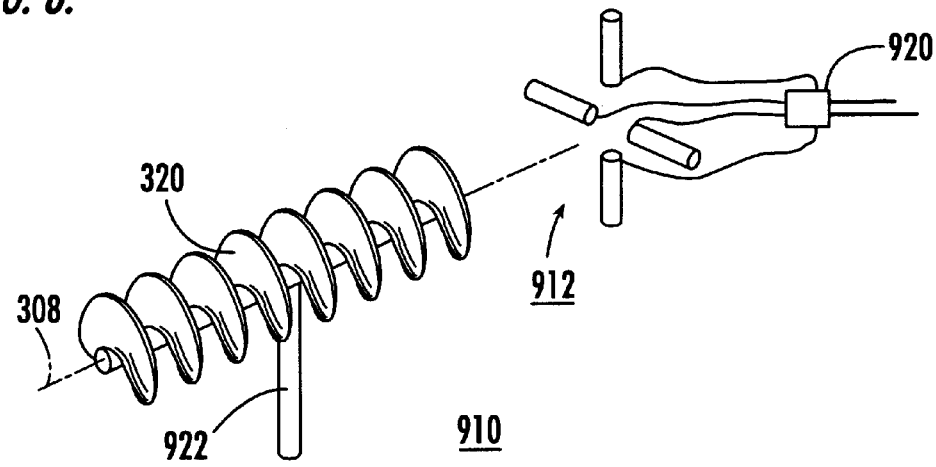
FIG. 9 is a simplified perspective or isometric view of an antenna or antenna element according to an aspect of the invention, in which the circularly polarized feed includes a quadrature-fed crossed dipole.

FIG. 9 is a simplified perspective or isometric view of an antenna element 910 according to an aspect of the invention, in which the circularly polarized feed includes a crossed dipole arrangement 912 fed by a quadrature arrangement 920. Auger director arrangement 320 is supported by a dielectric rod 922.

Figure 10:
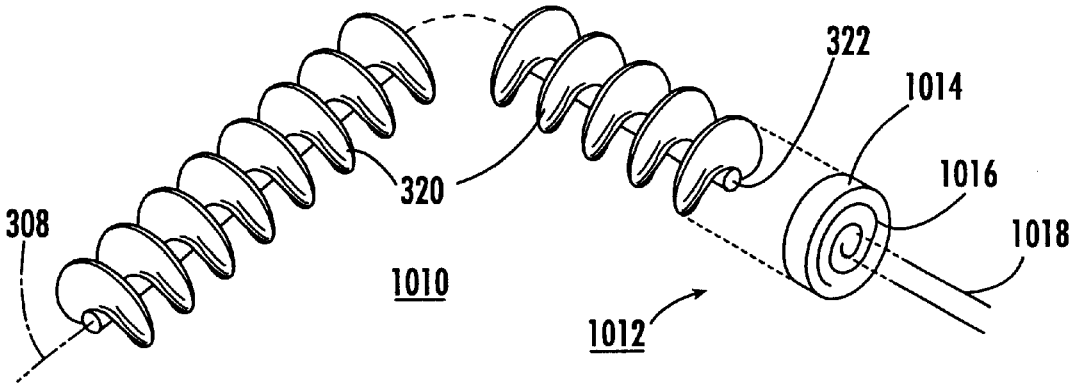
FIG. 10 is a simplified representation of an auger director according to an aspect of the invention, with a circularly polarized Archimedean spiral feed.

FIG. 10 is a simplified representation of an auger director 320 with a feed 1012. Feed 1012 includes a dielectric disk or film 1014 which fits against the feed end of the auger director. The disk or film 1014 supports a bifilar Archimedean spiral antenna as known per se, fed at its center by a balanced transmission line 1018. As an alternative, such spirals can be fed from their outer edges by use of a coaxial transmission line, the outer conductor of which is in electrical contact with one of the spirals, and the center conductor of which is connected to the other spiral.

Figure 11:
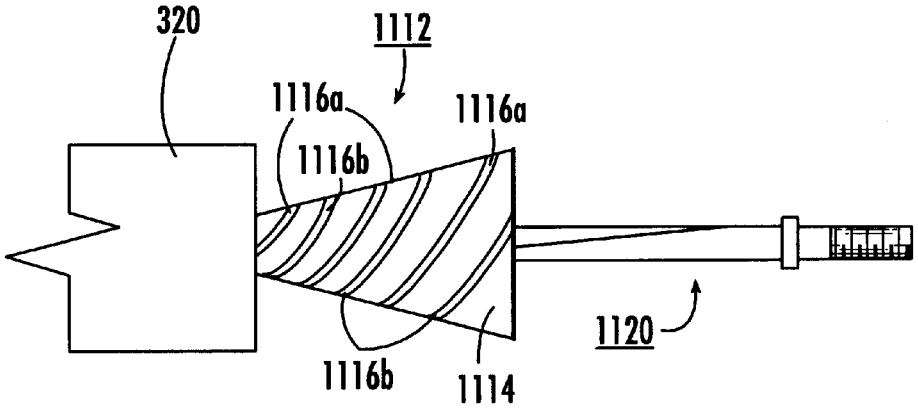
FIG. 11 is a simplified representation of another form which the feed could take in an antenna or antenna element according to an aspect of the invention, in which the feed includes a hollow dielectric shell in the form of the frustum of a cone having its apex or smallest-diameter portion adjacent one end of the auger director, with bifilar conductors wound about the cone in interleaved fashion.

FIG. 11 is a simplified representation of another form which the feed could take. In FIG. 11, the feed 1112 for antenna 1110 includes a hollow dielectric shell 1114 in the form of the frustum of a cone having its apex or smallest-diameter portion adjacent one end of auger director 320. Bifilar conductors 1116*a* and 1116*b* are wound about the cone in interleaved fashion. The windings are fed in mutual antiphase by means of a balun 1120, which is illustrated as being of the tapered-outer-conductor coaxial type, which tapers from a coaxial form at one end to a two-wire configuration at the other end. Such baluns tend to have very broad bandwidths.

Figure 12:
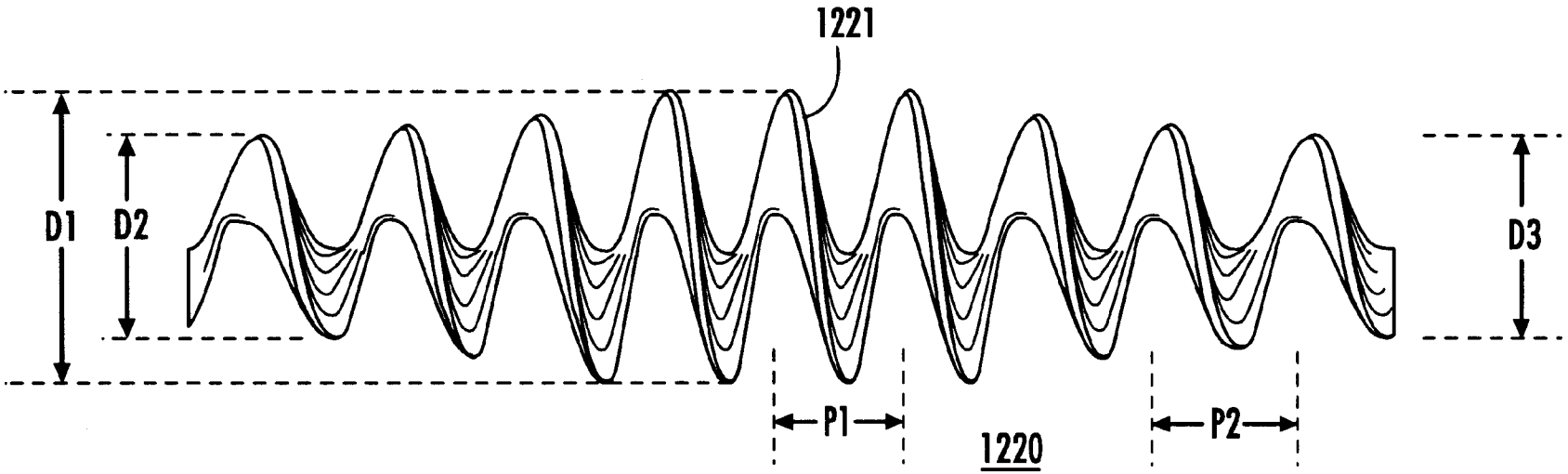
FIG. 12 is a perspective or isometric view of an auger director according to an aspect of the invention, in which a helically disposed conductor defines a variable projected diameter and pitch over its length.

FIG. 12 is a perspective or isometric view of an auger director 1220 having a helically disposed conductor 1221 which defines a variable projected diameter over its length, and which has a variable pitch. More particularly, the helical conductor 1221 has a projected diameter D1 at a location between the ends, which diameter D1 is greater than the diameters D2 and D3 at the ends. Also, the pitch P1 and P2 is different at different locations along the length. These parameters may be used to adjust the electrical performance of an antenna using such a director over the frequency band of interest. Naturally, it may not be necessary to vary both the pitch and projected diameter in all situations, but variation of one or the other may suffice.

Figure 13A:
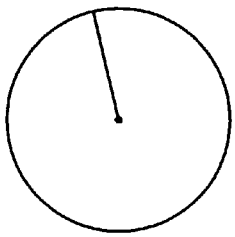
FIGS. 13*a*, 13*b*, and 13*c* illustrate end views of the end turn of various self-supporting auger helical director elements which may be used in an antenna according to the invention.
Figure 13B:
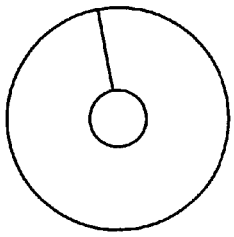
Figure 13C:
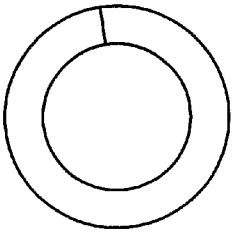

FIGS. 13*a*, 13*b*, and 13*c* illustrate end views of the end turn of various self-supporting helical director elements which may be used in an antenna according to the invention. In FIG. 13*a*, the helical element may be viewed as being similar to that of the arrangement of FIG. 12. The turn of FIG. 13*b* shows the presence of an axial aperture, and the turn of FIG. 13*c* shows a larger axial aperture. The axial apertures may be vacant, or if support is desired, may accommodate a conductive or nonconductive support rod. Adjustment of the diameter of the central aperture relative to the outer diameter of the auger director element affects the radiation pattern characteristics.

Other embodiments of the invention will be apparent to those skilled in the art. For example, while the explanation of the operation of the antenna describes a planar wavefront arriving at the auger director, this condition would be true or exist only in the reception mode of operation, where the signal source is at a great distance from the receiving antenna. When operating in a transmit mode, in which the source of electromagnetic radiation is preferably near the proximal end of the director, the plane-wavefront assumption will not ordinarily be met. Nevertheless, actual experiments have indicated that the antenna auger director as described does perform the linear-to-circular polarizing directivity enhancement. While dimensions of a particular embodiment are given, those skilled in the art know that the dimensions of the director and the feed, including the number of turns, the projected diameter, the pitch, and other parameters may be selected to suit the operating frequency range, the desired gain, the impedance seen at the feed, the bandwidth, and other considerations such as resistance to vibration, weight, corrosion resistance, and the like. The slot-in-ground-plane feed illustrated in conjunction with FIG. 5 may use a cavity backing or other technique for preventing or reducing unwanted radiation into the half-universe behind the ground plane. While transmission lines have been illustrated as two-wire lines or waveguides, those skilled in the art know that variants such as microstrip, stripline, coax, finline, and other types may be used instead in particular situations. Where bifilar windings are described, multifilar windings with numbers of windings other than two may be used, in known fashion. Where helically disposed windings are described for the feed, the windings may as known be of uniform thickness or may taper according to some mathematical formula, such as the well-known equiangular spiral or helix. The auger director element has been described as "wound," but those skilled in the art know that an element disposed in the described arrangement may be fabricated or formed in many ways, as by casting molten metal in a mold, or by machining from a blank, neither of which require an actual winding operation.

Thus, in the most general terms, an antenna, or in the context of an array an antenna element, according to the invention includes a feed and a polarization converting auger director. The feed does not couple to the auger director element except by way of electromagnetic radiation; or put another way, there is no direct electrical "contact" with the director element (although there may be an electrically conductive physical support element connecting the two). The polarization converting director includes a helically disposed conductor defining a pitch, a projected diameter, and a longitudinal axis. The feed propagates electromagnetic radiation (in transmit mode) parallel to the axis of the director. The director intercepts a part of, or most of, the radiation, and focuses or directs the radiation, and also converts circular polarization to linear, or linear polarization to circular. The feed may thus be linearly or circularly polarized. Various feeds include waveguides or horns, slots, dipoles, and planar or nonplanar spirals.

More specifically, an antenna, or in the context of an array an antenna element (210, 310, 410, 510, 610) according to an aspect of the invention comprises an electrically conductive director element (220, 320, 1220) helically disposed about a longitudinal axis (208, 308), and a feed (212, 312, 512, 612, 712, 812, 912, 1012, 1112) spaced away from the element (220, 320, 1220), for transducing electromagnetic radiation (214) propagating in the direction (216) of the longitudinal axis (208, 308). In an avatar of the antenna or antenna element (210, 310, 510, 610), the feed (212, 312, 512, 612) is linearly polarized, and the helically disposed element (220, 320, 1220) converts between linear and nominally circular polarization. The feed (212, 312, 512, 612, 712, 812, 912, 1012, 1112) may be an open (open-ended 312 or radiating) waveguide (314), a slot (512), a dipole (612, 712, 812, 912, 1012, 1112), or any other source or sink of linearly polarized electromagnetic energy. In another avatar (710, 810, 910) of the antenna element, the feed (712, 812, 912) is nominally circularly polarized, and the helically disposed director element (220, 320, 1220) converts between linear and nominally circular polarization. In this avatar, the feed (712, 812, 912) may include an open waveguide structure, as for example an oval or circular waveguide (714*a*, 714*b*), or it may include a crossed-slot (812) or crossed-dipole (912) antenna. Yet another embodiment may have as a circularly polarized feed a planar (1012) or nonplanar (1112) spiral antenna.

In one particular embodiment of an antenna element (210, 310, 410, 510, 610, 710, 810, 910) according to an aspect of the invention, the helically wound element (220, 320, 1220) has a projected diameter (D, D1, D2, D3) of about one-third wavelength at a frequency within the operating band. In that particular embodiment, the pitch (PD) of the helically wound element is about one-third wavelength. The pitch may be fixed over the axial length of the helically wound element, or the pitch may vary over that length. Similarly, the projected diameter may be fixed over the length of the helically wound element, or it may vary. In one embodiment exhibiting variation in projected diameter, the projected diameter is greater at a location lying between the ends of the helically wound element. Naturally, both the pitch and the projected diameter may vary over the length of the helically wound element.

A particularly advantageous embodiment of an antenna element (210, 310, 410, 510, 610) according to a hypostasis of the invention supports the helically wound element (220) on an electrically conductive rod (222, 222*e*) extending axially through at least some of the turns of the helically wound element (220), or preferably through all of the turns of the helically wound element. A feed (212, 312, 512) according to one version of the invention may include a linearly polarized aperture (312, 512, 612, 712, 812, 912, 1012, 1112) surrounded by an electrically conductive material (walls of 314), in which the rod (220*e*) is supported by a further electrically conductive transverse element (310) oriented in the H plane of the feed (212, 312, 512), extending across the aperture (312, 512, 612, 712, 812, 912, 1012, 1112), and in galvanic contact with the electrically conductive material surrounding the aperture, so that a continuous galvanic path extends from the conductive winding (220), through the rod (222, 222*e*), and through the further electrically conductive transverse element (310) to the electrically conductive material surrounding the aperture.

What is claimed is:

1. An antenna, comprising:

a single unpaired elongated electrically conductive element helically disposed about a longitudinal axis: and a feed spaced from said element in the direction of said longitudinal axis, for transducing electromagnetic radiation in the direction of said longitudinal axis.

2. An antenna according to claim 1, wherein said feed is linearly polarized, and said helically disposed element converts between linear and nominally circular polarization.

3. An antenna according to claim 2, wherein said feed comprises an open waveguide.

4. An antenna according to claim 2, wherein said feed comprises a slot.

5. An antenna according to claim 2, wherein said feed comprises a dipole.

6. An antenna according to claim 1, wherein said feed is nominally circularly polarized, and said helically disposed element converts between linear and nominally circular polarization.

7. An antenna according to claim 6, wherein said feed comprises an open circular waveguide structure.

8. An antenna according to claim 1, wherein said helically wound element has a projected diameter of about one-third wavelength at a frequency within the operating band.

9. An antenna according to claim 1, wherein said helically wound element comprises a pitch of about one-third wavelength.

10. An antenna according to claim 9, wherein said pitch is fixed over the axial length of said helically wound element.

11. An antenna according to claim 9, wherein said pitch varies over at least a portion of the axial length of said helically wound element.

12. An antenna according to claim 1, wherein said helically wound element is supported on an electrically conductive rod extending axially through at least some of the turns of said helically wound element.

13. An antenna according to claim 1, wherein both the pitch and projected diameter defined by said helically disposed electrically conductive element differ at different locations along the axial length of said helix.

14. An antenna, comprising:

an elongated electrically conductive element helically disposed about a longitudinal axis; and a nominally circularly polarized feed spaced from said element, for transducing electromagnetic radiation in the direction of said longitudinal axis, wherein said feed comprises a crossed-slot structure, and wherein said helically disposed element converts between linear and nominally circular polarization.

15. An antenna, comprising:

an elongated electrically conductive element helically disposed about a longitudinal axis; and a nominally circularly polarized feed spaced from said element, for transducing electromagnetic radiation in the direction of said longitudinal axis, wherein said feed comprises a crossed-dipole structure, and wherein said helically disposed element converts between linear and nominally circular polarization.

16. An antenna, comprising:

an elongated electrically conductive element helically disposed about a longitudinal axis; and a nominally circularly polarized feed spaced from said element, for transducing electromagnetic radiation in the direction of said longitudinal axis, wherein said feed comprises a spirally disposed conductor, and wherein said helically disposed element converts between linear and nominally circular polarization.

17. An antenna, comprising:

an elongated electrically conductive element helically disposed about a longitudinal axis said helically wound element being supported on an electrically conductive rod extending axially through at least some of the turns of said helically wound element; and a feed spaced from said element, for transducing electromagnetic radiation in the direction of said longitudinal axis, wherein said feed comprises a linearly polarized aperture surrounded by an electrically conductive material, and said rod is supported by a further electrically conductive element oriented in the H plane, extending across said aperture, and in galvanic contact with said electrically conductive material surrounding said aperture, so that a continuous galvanic path extends from said conductive winding, through said rod, and through said further electrically conductive element to said electrically conductive material surrounding said aperture.

* * * * *